US005318700A

United States Patent [19]

Dixon et al.

[11] Patent Number: 5,318,700

[45] Date of Patent: Jun. 7, 1994

[54] ENGINE AND RADIATOR COOLANT TREATMENT AND HANDLING, ENABLING COOLANT REUSE

[75] Inventors: Patrick L. Dixon, Riverside, Calif.; Walter Lubberts, Bramalea; Geoffrey H. Wooley, Toronto, both of Canada

[73] Assignee: Wynn Oil Company, Azusa, Calif.

[21] Appl. No.: 926,026

[22] Filed: Aug. 7, 1992

[51] Int. Cl.[5] ..... C02F 1/52

[52] U.S. Cl. ..... 210/167; 210/205; 210/241; 210/712; 210/732; 210/805; 123/41.14; 123/41.01; 165/95; 134/22.1; 134/41; 134/22.18

[58] Field of Search ..... 210/241, 167, 712, 728, 210/732, 805, 205; 123/41.14, 41.01; 165/95; 134/41, 22.1, 22.11, 22.12, 22.18

[56] References Cited

U.S. PATENT DOCUMENTS

| | | | |
|---|---|---|---|
| Re. 31,274 | 6/1983 | Babish et al. | 165/95 |
| 1,582,300 | 4/1926 | Otis . | |
| 1,701,824 | 2/1929 | Robinson . | |
| 1,742,281 | 1/1930 | Rundlett . | |
| 2,187,413 | 1/1940 | Boezi et al. | 134/96.1 |
| 2,188,245 | 1/1940 | Middleton | 165/137 |
| 3,094,131 | 6/1963 | Williams | 134/98.1 |
| 3,115,145 | 12/1963 | Monteath, Jr. | 134/95.1 |
| 3,409,218 | 11/1968 | Moyer | 237/12.3 B |
| 3,540,528 | 11/1970 | Moon | 210/167 |
| 3,540,588 | 11/1970 | Estabrook | 210/195 |
| 3,776,384 | 12/1973 | Offer | 210/209 |
| 3,954,611 | 5/1976 | Reedy | 210/223 |
| 4,015,613 | 4/1977 | Papworth | 134/102 |
| 4,029,115 | 6/1977 | Wheeler | 134/111 |
| 4,052,308 | 10/1977 | Higgs | 210/167 |
| 4,054,150 | 10/1977 | Thomas | 123/41.01 |
| 4,083,399 | 4/1978 | Babish et al. | 165/95 |
| 4,086,930 | 5/1978 | Hiss | 60/336 |
| 4,109,703 | 8/1978 | Babish et al. | 165/1 |
| 4,127,160 | 11/1978 | Joffe | 165/1 |
| 4,128,140 | 12/1978 | Riches | 184/1.5 |
| 4,161,979 | 7/1979 | Stearns | 165/95 |
| 4,167,193 | 9/1979 | Magnus et al. | 134/95 |
| 4,176,708 | 12/1979 | Joffe | 165/95 |
| 4,209,063 | 6/1980 | Babish et al. | 165/95 |
| 4,276,914 | 7/1981 | Albertson | 141/92 |
| 4,293,031 | 10/1981 | Babish et al. | 165/95 |
| 4,338,959 | 7/1982 | Krueger et al. | 137/93 |
| 4,343,353 | 8/1982 | Tsopelas | 165/119 |
| 4,366,069 | 12/1982 | Dudrey et al. | 210/788 |
| 4,390,049 | 6/1983 | Albertson | 141/92 |
| 4,553,587 | 11/1985 | Traylor | 165/95 |
| 4,606,363 | 8/1986 | Scales | 134/111 |
| 4,615,794 | 10/1986 | Belanger | 208/181 |
| 4,671,230 | 6/1987 | Turnipseed | 134/20 |
| 4,790,882 | 12/1988 | Barres | 134/22.18 |
| 4,791,890 | 12/1988 | Miles et al. | 123/41.14 |
| 4,793,403 | 12/1988 | Vataru et al. | 165/95 |
| 4,809,769 | 3/1989 | Vataru et al. | 165/1 |
| 4,899,807 | 2/1990 | Vataru et al. | 165/1 |
| 4,901,786 | 2/1990 | Vataru et al. | 165/1 |
| 4,946,595 | 8/1990 | Miller, Jr. | 210/651 |
| 4,949,682 | 8/1990 | Klein | 210/167 |
| 5,021,152 | 6/1991 | Filowitz et al. | 210/712 |
| 5,078,866 | 1/1992 | Filowitz et al. | 210/167 |
| 5,094,757 | 3/1992 | Light | 210/712 |

FOREIGN PATENT DOCUMENTS

| | | |
|---|---|---|
| 1028634 | 5/1953 | France . |
| 1362962 | 4/1964 | France . |
| 2086488 | 5/1982 | United Kingdom . |

OTHER PUBLICATIONS

European Search Report EP 90 10 2607 dated May 23, 1990.

*Primary Examiner*—Neil McCarthy
*Attorney, Agent, or Firm*—William W. Haefliger

[57] ABSTRACT

The method of treating used liquid coolant employed in the coolant passages of an engine or radiator, and employing a coolant pumping structure, that includes providing a source of supply coolant liquid, and a used coolant reservoir; operating the pumping structure to displace supply coolant liquid from the source into the coolant passages, thereby displacing used coolant from the passages for flow into the reservoir structure; and chemically treating the used coolant liquid to remove metallic and other contaminants therefrom, thereby to produce treated coolant liquid usable as the supply coolant liquid.

12 Claims, 4 Drawing Sheets

ENGINE AND RADIATOR COOLANT TREATMENT AND HANDLING, ENABLING COOLANT REUSE

BACKGROUND OF THE INVENTION

This invention relates generally to treatment of coolant liquid associated with internal combustion engine cooling systems, and more particularly to treatment of used coolant externally of such systems, for subsequent return to the systems.

Studies show that over-heating is a major cause of vehicle breakdown on highways. Engine cooling systems must operate efficiently at all times to avoid costly repairs that result from excessive temperature. In this regard, cooling systems contaminated by rust, scale build-up and sludge cannot provide adequate heat transfer and cooling system efficiency; in addition, thermostats fail to open, hoses deteriorate, impellets bind or break off, and engine blocks can become distorted or crack.

Accordingly, there is a need for efficient engine cooling system flushing methods and apparatus; however, flushing of such systems in the past required draining of the removed liquid to sewer or waste lines, which was environmentally objectionable. Accordingly, need has developed for apparatus and method to clean engine coolant systems without such drainage. No way was known for accomplishing this objective in the usually advantageous manner, as is now provided by this invention. In addition, the removal of harmful cations (including those of lead, iron and copper) and anions, in the used coolant, has presented a serious problem.

SUMMARY OF THE INVENTION

It is a major object of the invention to provide procedures and apparatus characterized as overcoming the above objections and as meeting the above needs, whereby rapid and efficient cleaning of the engine coolant system may be accomplished in an environmentally non-objectionable manner.

As will be seen, the method involves treatment of used liquid coolant employed in the coolant passages of an engine and/or radiator, and employing a coolant pumping means, the method including the steps:

a) providing a source of supply coolant liquid, and a used coolant reservoir, b) operating the pumping means to displace supply coolant liquid from the source into the coolant passages, thereby displacing used coolant from those passages for flow into the reservoir outside the engine and radiator, c) and chemically treating the used coolant liquid to remove metallic and other contaminants therefrom, thereby to produce treated coolant liquid usable as the supply coolant liquid.

It is another object to provide for transfer of treated coolant liquid from the reservoir to the source of supply coolant liquid, for reuse of same, as for example, after used coolant liquid from a number of vehicle engines or radiators has been collected in the reservoir and treated. Such transfer is typically effected by operating the pumping means referred to, whereby that pumping means has multiple functions associated with displacement of coolant liquid from the source into the coolant passages, and transfer of the treated coolant liquid from the reservoir, as referred to. Connections to enable such multiple functions of a single pumping means will be described herein.

It is another object of the invention to provide for treating of the used coolant liquid, as referred to, by adding cationic and anionic synthetic materials to the reservoir means and mixing the materials with the used coolant liquid. Such mixing may advantageously be effected by directing a stream of gas under pressure, as for example compressed air, into the used coolant in the reservoir to which the treatment chemicals have been added, such compressed air normally being available at automotive service centers.

A further object is to provide for filtering of the treated coolant liquid during the transfer step from the reservoir to the source, thereby to remove agglomerate particles from the flowing stream of liquid being transferred. In this regard, filtering desirably takes place at locations both upstream and downstream of the pumping means, during the transferring step, thereby to remove agglomerate prior to arrival of the treated liquid at the supply source.

Yet another object of the invention concerns provision of a movable carrier, such as a wheeled cart, locating the pump means on the carrier, and also locating the filtering means, as referred to on the carrier. Accordingly, when the pumping means is employed to supply coolant liquid from the source to the engine or radiator coolant passages, filtering of the flowing supply liquid takes place; and when the pumping means is otherwise used to transfer treated coolant from the reservoir to the source of supply liquid, filtering of the liquid being transferred also takes place. Wheeling of the cart to the vehicle for connection into the engine or radiator coolant system is thereby enabled; and wheeling of the cart to another location for connection to the reservoir and supply source is also enabled, whereby dual use of the pumping means is enabled. The supply source may, in this regard, be located directly on the carrier or cart, as referred to.

Yet another object concerns the provision of pumping means having an inlet and an outlet, one of the inlet and outlet being connectible to a hose associated with engine coolant passages; and the other of the inlet and outlet being connectible to the radiator port, as via a hose connection.

As will be seen, further objects of the invention have to do with provision of apparatus constructed to perform the steps of the method or methods described above, in an efficient and reliable manner, such apparatus being reliable in operation and having dual usages, as referred to.

These and other objects and advantages of the invention, as well as the details of an illustrative embodiment, will be more fully understood from the following specification and drawings, in which:

DRAWING DESCRIPTION

FIG. 1 is a diagrammatic view of a system incorporating the invention;

FIG. 1*a* is a fragmentary view showing a connection of engine and radiator coolant passages;

DETAILED DESCRIPTION

Figure 1:
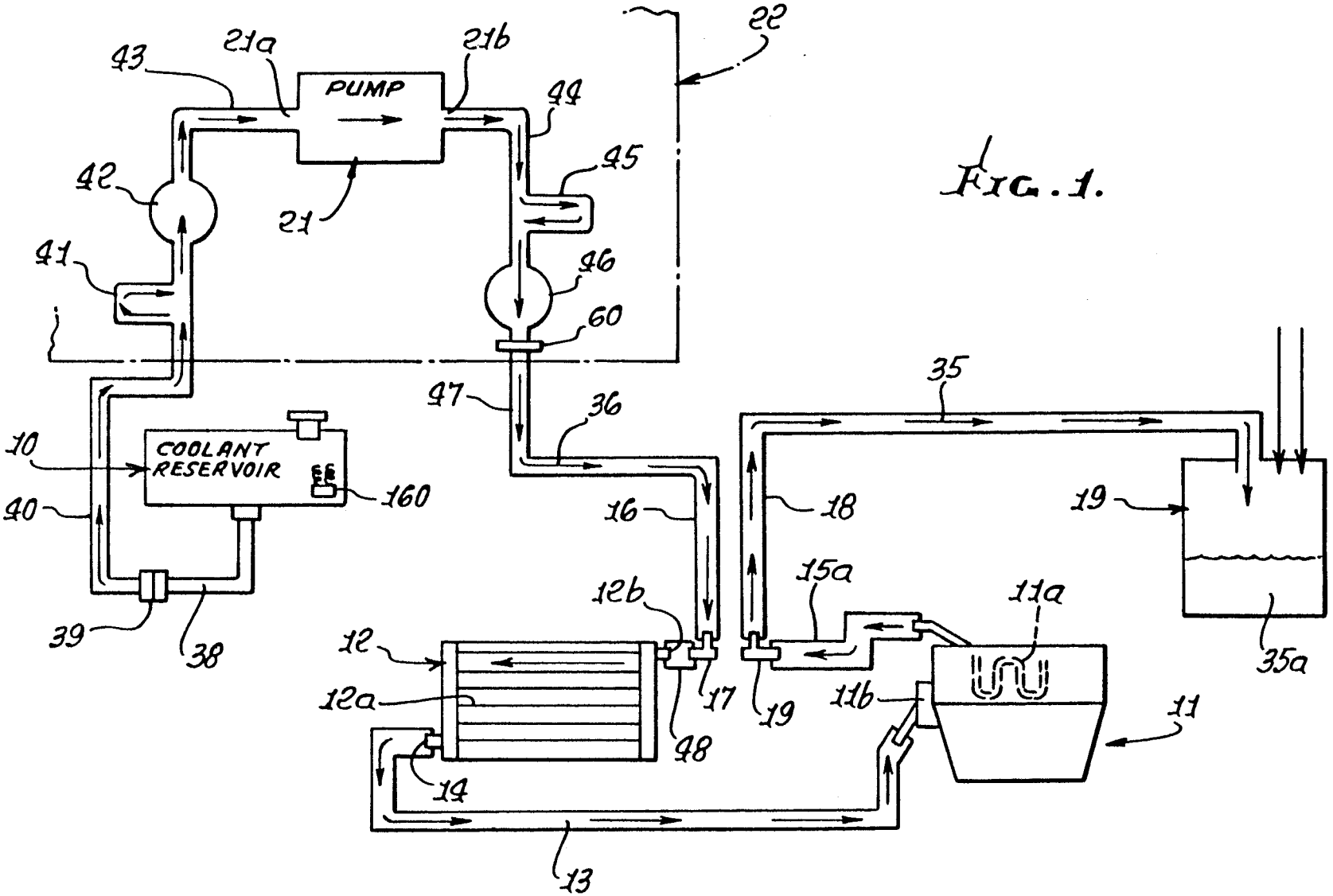

Referring first to FIG. 1, a source of supply coolant liquid usable in coolant passages of an engine and/or radiator is indicated at 10. That source may comprise a storage tank outside the usual coolant passages of the engine and radiator. Normally, the engine 11 and radiator 12 have coolant passages 11*a* and 12*a* interconnected in a loop, as for example is shown by the loop segment 13 flowing coolant from the radiator lower outlet 14 to the engine coolant passages 11*a*, via inlet 11*b* to the engine.

Figure 1A:
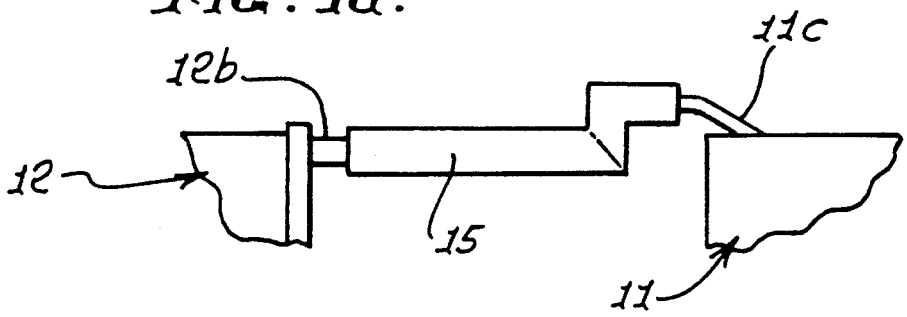

FIG. 1*a* shows another segment 15 of the loop comprising a hose extending from the engine outlet 11*a* to the radiator inlet 12*b*. In accordance with one aspect of the invention, the hose 15 is decoupled, and ducting is connected to the broken connection. See for example in FIG. 1 hose 16 connected to the radiator inlet 12*b* via adapter 17, and hose 18 connected to the engine outlet via adapter 19, and a portion of the hose 15 indicated at 15*a* in FIG. 1. Hose 18 extends to a used coolant reservoir 19, as shown.

Figure 4:
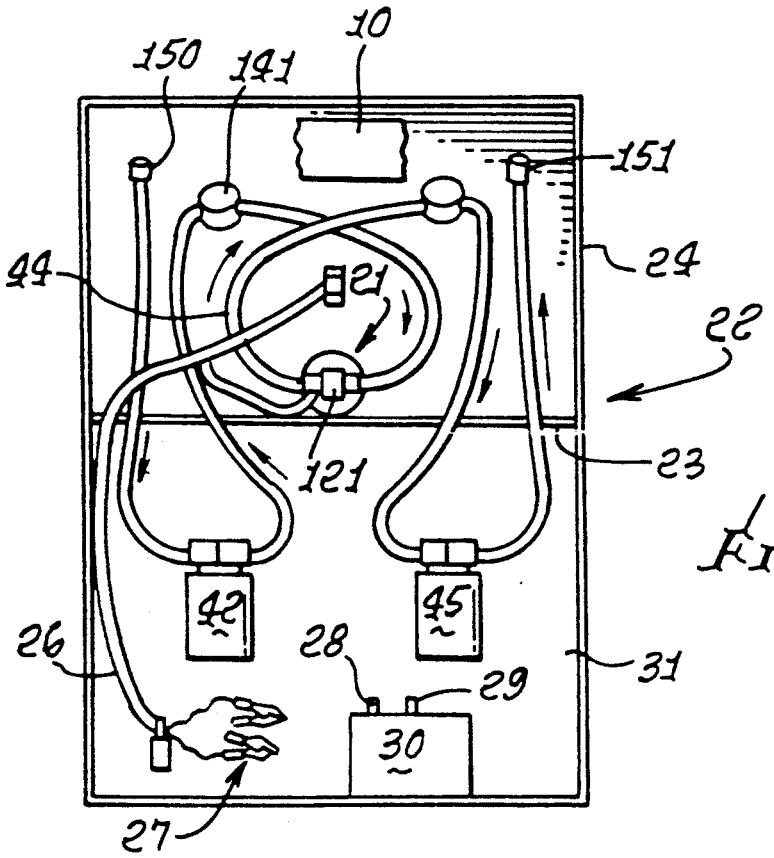
FIG. 4 is a rear view of a portion of the cart shown in FIG. 3.

In accordance with the invention, a coolant pumping means is provided for transferring coolant in the manner or manners to be described. That pumping means is indicated generally at 21; and it is also shown in FIG. 4 as preferably carried by the cart 22, as for example on a plate 23 within a cart cabinet 24. The pumping means typically includes an electrical, motor-driven centrifugal pump 21, cabling to supply electrical current to motor 121 being shown at 26 in FIG. 4. The pump may be of diaphragm type. Cable connections at 27 may be clamped onto terminals 28 and 29 of a battery 30 carried by the cart, as for example within the lower interior 31. Thus, when the pumping unit is not in use, the clamp connections 27 may be disconnected from the battery. The cart 22 has wheels 33 and a handle 34, whereby the cart can be easily moved to different positions as will appear, enabling the same pumping means to be used for multiple purposes during handling of the coolant fluid.

Figure 3:
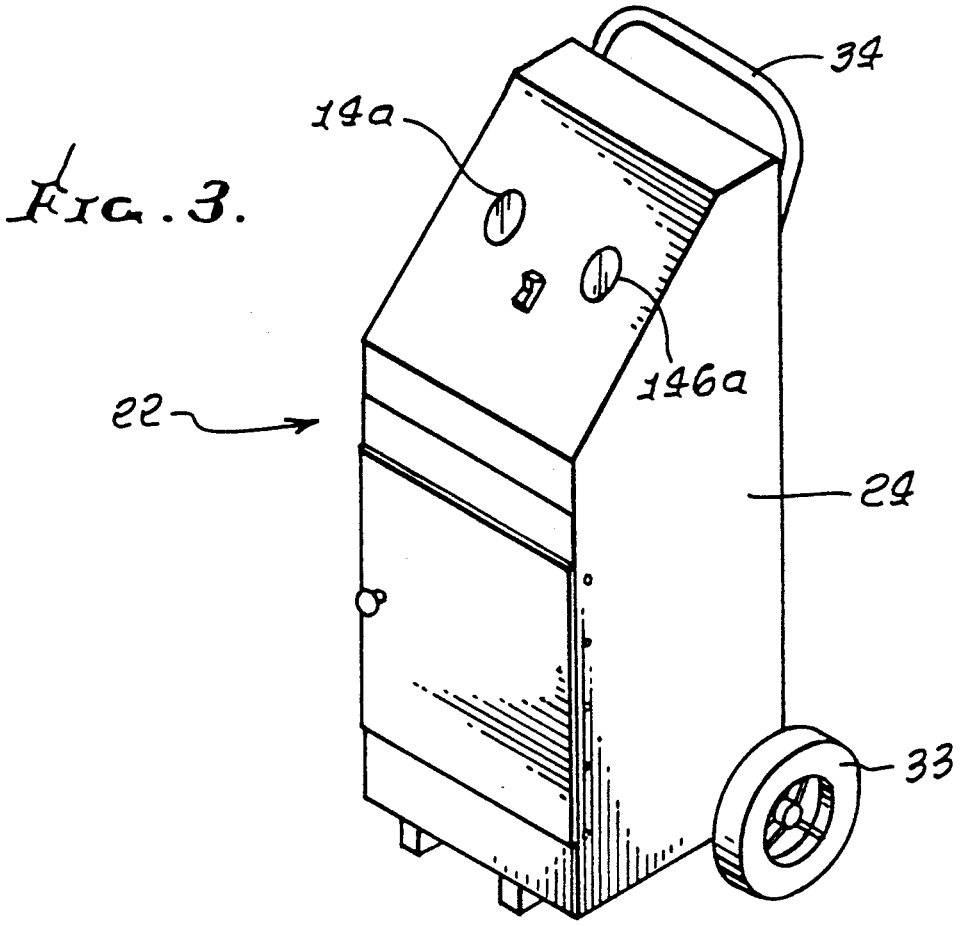
FIG. 3 is a perspective view a carrier in the form of a cart for pump means and other equipment.

As shown in FIG. 1, the system is in operation to displace supply coolant liquid from the source 10 into coolant passages of the radiator and engine, thereby to displace used coolant from such passages for flow into the reservoir 19. Arrows 35 indicate such displacement of used coolant from the engine and via 15*a*, 19 and 18, to the reservoir 19, where the used coolant collects at 35*a*. Such used coolant is forced from the coolant passages of the radiator and engine by the pressurized incoming supply of fresh coolant liquid, the flow of which is indicated at 36. In this regard, the pump 21 is operated to draw supply coolant from the source 10 to the pump inlet 21*a* via duct 38, quick coupling 39, duct 40, primary filter 41, primary filter indicator 42, and duct 43. Supply coolant leaves the pump via outlet 21*b* and flows to the radiator inlet 12*b* via duct 44, secondary filter 45, secondary filter indicator 46, duct 47, and adapter 17. A short hose connection between 17 and 12*b* is shown at 48. Flow indicator 141 in line 43 (see FIG. 4) typically comprises a spinner rotated by the flowing stream and visible through a window, as at 141*a* in FIG. 3. A flow pressure gauge 146 is in line 44, and visible via window 146*a* in FIG. 3. See also inlet and outlets 150 and 151 to the cabinet.

Accordingly, in one mode of operation, the pump means 21, as may be carried by the portable cart 22, is employed to transfer supply coolant into the coolant passages of the radiator and engine, and to drive used coolant from such passages for flow to the used coolant reservoir 19. This operation is typically performed upon multiple vehicle engines and/or radiators, whereby the reservoir 19, which may take the form of a barrel, accumulates used coolant from such multiple vehicle engines and/or radiators, as during the course of a day or other period.

When sufficient used coolant has been collected, the invention contemplates treatment of the latter, as for example in the same barrel 19, to enable its recycling to the coolant tank 10 for supply as fresh supply coolant to engine and radiator coolant passages, as referred to. In this regard, such transfer may be effected by the same pump means 21, as for example on the cart 22, in a second mode of operation thereof.

Figure 2:
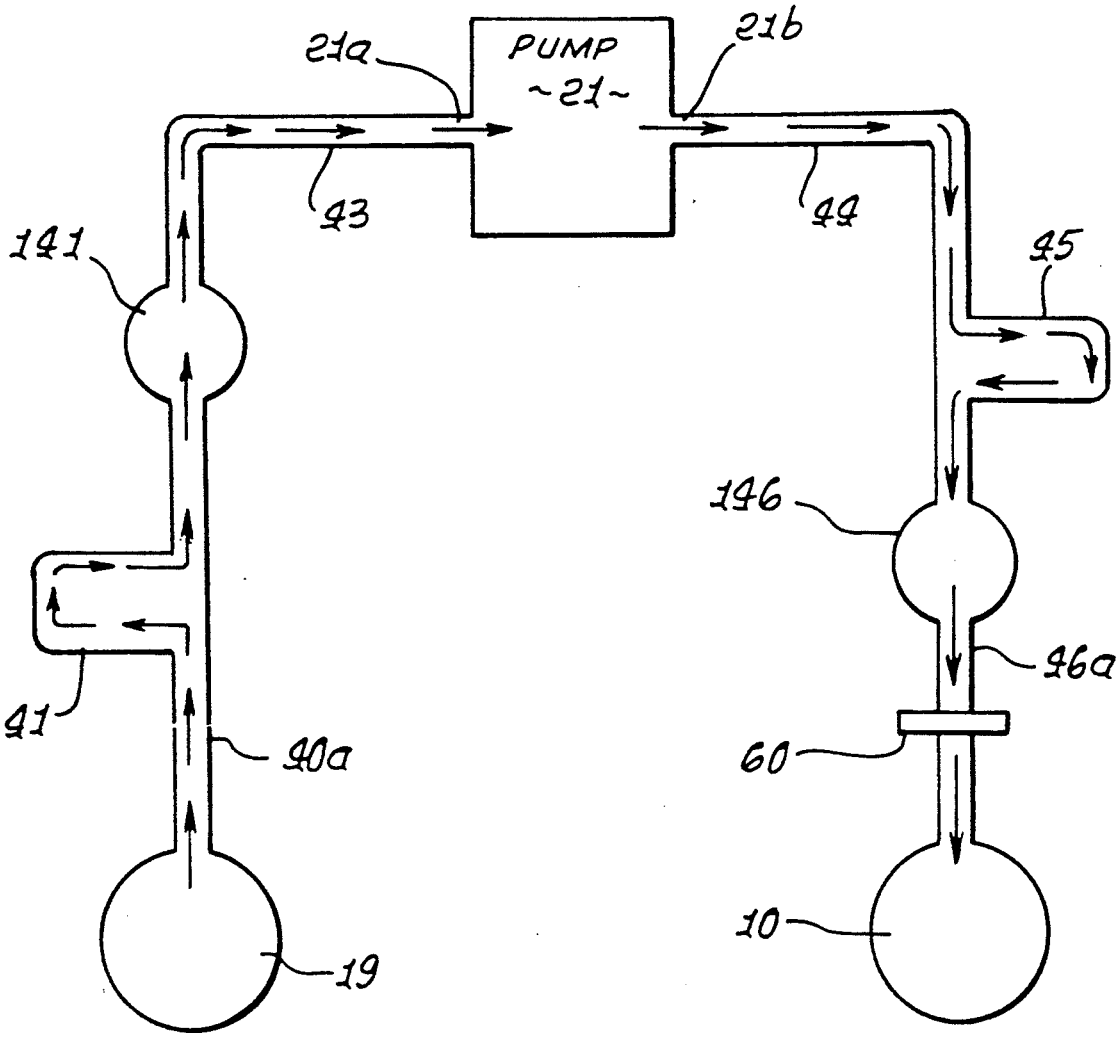
FIG. 2 is an enlarged view showing transfer of treated coolant from a reservoir to a supply source.

FIG. 2 shows such transfer from the reservoir 19 to the coolant tank 10 or, alternatively, a supply coolant auxiliary tank-.prior to feeding of the supply coolant to the tank 10. In this regard, the tank 10 may be directly carried by the cart 22, as indicated in FIG. 4; and it may be a smaller capacity unit than the storage tank indicated in FIG. 2 at 10.

In FIG. 1, the step of chemically treating the used coolant is shown, this step serving to remove metallic and other contaminants from the used coolant liquid thereby to produce treated coolant liquid usable as supply coolant liquid. See for example arrows 40′ and 41′ indicating the addition of cationic and anionic synthetic materials to the reservoir for mixing with the used coolant. Such mixing may be effected by introducing or directing a stream of gas under pressure into the used coolant in the reservoir 19, as for example after disconnection of a hose 35 from the reservoir. Such gas may comprise compressed air readily available at automotive service centers, several seconds of compressed air introduction into the reservoir normally being sufficient to thoroughly mix the reagents with the used coolant. Typically, first one reagent may be introduced as at arrow 40′ and the mixing then being effected; and, subsequently, the other reagent is introduced as via arrow 41′ and a second mixing step accomplished. See in this regard the description in U.S. Pat. No. 5,078,866 wherein the use of NETAMOX and PROTAZYNE for similar purposes is described in detail. Such description is incorporated by reference herein.

After the described treatment of the used coolant, it is transferred by the same pumping means to the storage tank 10, as shown in FIG. 2. Thus, the treated (i.e., cleaned-up) liquid coolant is drawn from 19 via duct 40*a*, filter 41, indicator 141, and duct 43, to the pump inlet 21*a*. Liquid discharging from the pump outlet 21*b* flows via 44, 45 and 146, and via duct 46*a*, to the storage tank 10. Therefore, the treated coolant liquid being transferred is subjected to additional treatment, i.e., filtering, at 41 and 45 to assure removal of particulate incapable of passing through the filters. The latter are replaceable, whereby contaminants, including agglomerates, are collected in the used filters for disposal in accordance with environmental regulation; and the invention enables recycling and reuse of coolant liquid, whereby such liquid is not objectionably introduced into the environment. Indicators 141 and 146 indicate, by observation of spinner rotation rates, whether the filters are becoming clogged and in need of replacement.

Figure 5:
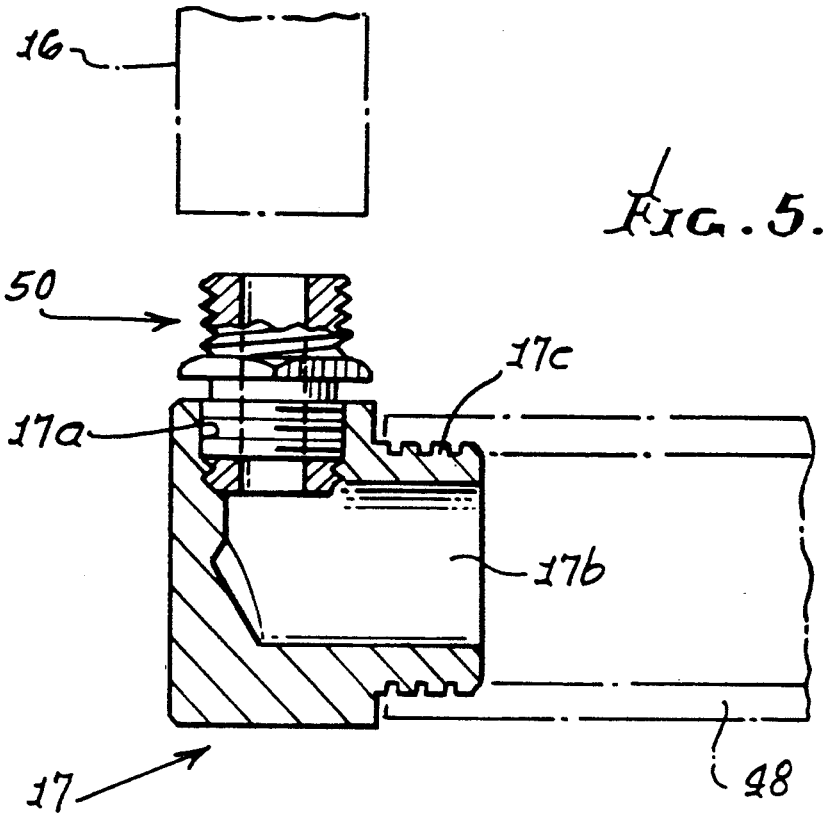
FIGS. 5 and 6 are sectional views of adapters employed in the system of FIG. 1.

FIG. 5 shows a coupling or adapter 17 having elbow shape, with a port 17*a* receiving a treated tubular fitting 50; the latter may be connected to hose 16. The opposite port 17*b* of the adapter has a serrated outer surface at 17*c* for clamping to the hose 48 at radiator inlet 12*b*, as shown in FIG. 1.

Figure 6:
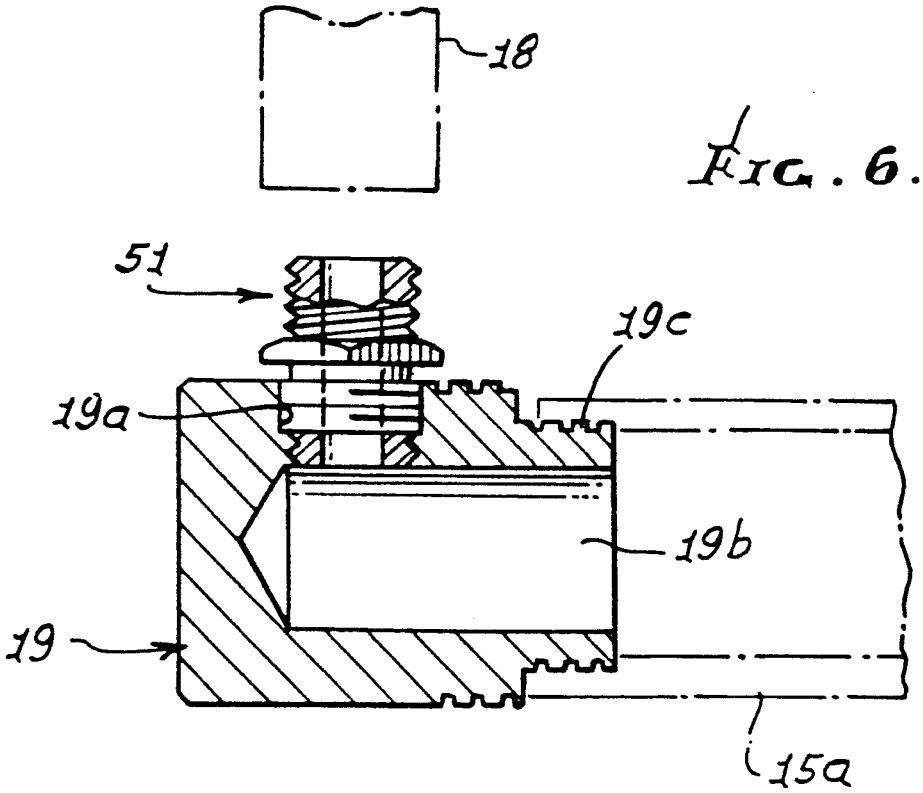

Referring to FIG. 6, the adapter 19 also has elbow shape, with an inlet port 19*a* receiving a threaded, tubular fitting 51. The latter is connectible to hose 18. The opposite end port 19*b* of the adapter has a serrated outer surface 19*c* to which hose connection 15*a* is attachable, as by suitable clamping.

In summary, the method of treating used liquid coolant employed in the coolant passages of an engine or radiator, and employing a coolant pumping means, includes the steps:

a) providing a source of supply coolant liquid, and a used coolant reservoir, b) operating the pumping means to displace supply coolant liquid from the source into the coolant passages, thereby displacing used coolant from the passages for flow into the reservoir means, c) and chemically treating the used coolant liquid to remove metallic and other contaminants therefrom, thereby to produce treated coolant liquid usable as the supply coolant liquid.

The same pumping means is usable to displace treated coolant liquid to the source of supply coolant liquid for reuse in the engine and radiator coolant passage system.

Periodically, concentrated contaminants at the bottom of barrel 19 may be removed for disposal.

An over-pressure sensor may be employed at 60 in FIG. 1, to shut off the pump motor.

A low level switch 160 may be employed in reservoir 10 in FIG. 1, to shut off the pump motor.

We claim:

1. The method of treating used liquid coolant employed in the coolant passages of multiple engines or radiators, and employing a coolant pumping means, that includes a) providing a source of supply coolant liquid said source including a container to supply coolant liquid, and a separate, used coolant reservoir, b) operating said pumping means to displace supply coolant liquid from said source into said coolant passages, of said multiple engines or radiators, thereby displacing used coolant from said passages for flow into said used coolant reservoir, c) chemically treating said used coolant liquid in said used coolant reservoir to remove metallic and other contaminants therefrom, thereby to produce treated coolant liquid usable as said supply coolant liquid, d) and, after said chemical treating, performing the step of transferring said treated coolant liquid directly from said used coolant reservoir to said container of supply coolant liquid, by operation of the same pumping means, wherein during said transferring none of said supply coolant liquid passes through said coolant passages.

2. The method of claim 1 wherein said treating includes adding cationic and anionic synthetic materials to said reservoir means and mixing said materials with said used coolant liquid.

3. The method of claim 2 wherein said mixing includes directing a stream of gas under pressure into said used coolant in said reservoir.

4. The method of claim 1 including filtering said treated coolant liquid during said transferring step, to remove agglomerates therefrom.

5. The method of claim 1 including filtering said treated liquid at locations both upstream and downstream of said pumping means, during said transferring step, thereby to remove agglomerates prior to arrival of the treated liquid at said supply coolant liquid source.

6. The method of claim 1 including providing a movable carrier, locating said pumping means on said carrier, and providing filter means for said filtering and also locating said filter means on said carrier.

7. The method of claim 6 including locating said supply coolant liquid source on said carrier.

8. The method of claim 6 including providing said carrier in the form of a movable cart.

9. The method of claim 1 which said b) step includes displacing used coolant liquid from both the engine and radiator, sequentially.

10. The method of claim 1 wherein said pumping means has an inlet and an outlet wherein the radiator has a hose connection proximate a radiator port, the hose also connected with the engine coolant passages, and the method includes disconnecting said hose connection, and connecting one of the pumping means inlet and outlet to the hose and the other of said inlet and outlet to the radiator port.

11. The method of claim 7 wherein the same pumping means on said carrier is used for said b) step and said treated coolant transferring.

12. Apparatus for treating used liquid coolant employed in cooling passages of multiple engines or radiators, comprising:

a) a motor-driven pump on a carrier, b) a source of supply coolant liquid including a coolant liquid container, and hoses and adapter connections connected in series with said pump and radiator coolant passages, and in series with engine coolant passages and an external used coolant reservoir means, c) the pump operable in a first mode to displace supply coolant liquid from said source container into said coolant passages, thereby displacing used coolant from said passages of multiple engines or radiators for flow into said used coolant reservoir means, d) whereby used coolant liquid in the reservoir means may be chemically treated to remove metallic and other contaminants therefrom, thereby to produce treated coolant liquid usable as said supply coolant liquid, e) the pump operable in a second mode to displace treated, used coolant from said reservoir means to said source container, f) means for coupling said source container to said cooling passages for coolant liquid flow to said passages, during pump operation in said first mode, g) and means for directly coupling said reservoir means to said source container via said pump for effecting treated coolant flow from said reservoir means to said container during operation of the same pump in said second mode, such that none of said coolant from said source container passes through said coolant passages.

* * * * *